US009701451B2

(12) United States Patent
Skillin et al.

(10) Patent No.: US 9,701,451 B2
(45) Date of Patent: Jul. 11, 2017

(54) DISPENSING CLOSURE

(71) Applicant: MWV SLATERSVILLE, LLC, Slatersville, RI (US)

(72) Inventors: Clifford Skillin, Blackstone, MA (US); Patrick J Brannon, Warwick, RI (US)

(73) Assignee: SILGAN DISPENSING SYSTEMS SLATERSVILLE LLC, North Smithfield, RI (US)

( * ) Notice: Subject to any disclaimer, the term of this patent is extended or adjusted under 35 U.S.C. 154(b) by 0 days.

(21) Appl. No.: 14/911,746

(22) PCT Filed: Aug. 14, 2014

(86) PCT No.: PCT/US2014/051024
§ 371 (c)(1),
(2) Date: Feb. 12, 2016

(87) PCT Pub. No.: WO2015/023829
PCT Pub. Date: Feb. 19, 2015

(65) Prior Publication Data

US 2016/0272379 A1 Sep. 22, 2016

Related U.S. Application Data

(60) Provisional application No. 61/866,629, filed on Aug. 16, 2013, provisional application No. 61/989,077, filed on May 6, 2014.

(51) Int. Cl.
*B65D 47/08* (2006.01)
*B65D 75/58* (2006.01)
*B65D 51/20* (2006.01)

(52) U.S. Cl.
CPC ..... *B65D 47/0838* (2013.01); *B65D 51/20* (2013.01); *B65D 75/5883* (2013.01);
(Continued)

(58) Field of Classification Search
CPC B65D 47/0838; B65D 51/20; B65D 75/5883; B65D 2251/105;
(Continued)

(56) References Cited

U.S. PATENT DOCUMENTS 5,606,844 A * 3/1997 Takagaki ..... B29C 65/08 53/133.2
2004/0188374 A1 9/2004 Ochoa Laburu
(Continued)

FOREIGN PATENT DOCUMENTS

DE 102007030156 A1 1/2009
DE 202012003293 U1 7/2013
(Continued)

*Primary Examiner* — Donnell Long
(74) *Attorney, Agent, or Firm* — Barlow, Josephs & Holmes, Ltd.

(57) ABSTRACT

A one-piece dispensing closure (10) for a pouch-like container (13) includes an integrally formed closure body (11), dispensing neck (30), hinged cap (20), a tamper-evident closure system (40) and a latch (62) for maintaining the cap (20) in an open position. The closure body (11) includes a "canoe"-shaped skirt portion (14) with opposing skirt walls (17,19) which are heat sealed to a film-like pouch (13) and a neck portion (30) having a dispensing orifice (34). The closure body (11) may further include reinforcing ribs (21) extending transversely between the skirt walls (17, 19) to provide support while the pouch is heat sealed to the skirt. A cap (20) is connected to the closure body (11) by a living hinge (26) to allow the user to selectively open and close the container. A tamper-evident tear strip (40) may be integrally formed with the neck portion (30). A locking tab (50) on the cap (20) engages a shoulder (42) on the tear strip (40) to prevent opening of the cap (20) without removing the tear strip (40). The closure (10) may include a liner (102) sealed over the dispensing orifice (34)

13 Claims, 14 Drawing Sheets

(52) U.S. Cl.
CPC ..... *B65D 2101/0023* (2013.01); *B65D 2101/0038* (2013.01); *B65D 2251/0025* (2013.01); *B65D 2251/0093* (2013.01); *B65D 2251/105* (2013.01); *B65D 2251/1008* (2013.01)

(58) Field of Classification Search
CPC .... B65D 2101/0038; B65D 2101/0023; B65D 2251/0025; B65D 2251/1008; B65D 2251/0093
USPC ..... 222/153.07
See application file for complete search history.

(56) References Cited

U.S. PATENT DOCUMENTS

| | | | | |
|---|---|---|---|---|
| 2005/0279727 | A1 | 12/2005 | Graswald et al. | |
| 2009/0139993 | A1* | 6/2009 | Last ..... | B29C 65/02 220/601 |
| 2012/0279966 | A1 | 11/2012 | Mazurkiewicz et al. | |
| 2013/0087523 | A1 | 4/2013 | Ziegenhorn et al. | |
| 2014/0263474 | A1 | 9/2014 | Skillin et al. | |

FOREIGN PATENT DOCUMENTS

| | | | |
|---|---|---|---|
| FR | 2905359 | A1 | 3/2008 |
| GB | 2269809 | A | 2/1994 |
| WO | WO2009/117771 | A1 | 10/2009 |

* cited by examiner

DISPENSING CLOSURE

BACKGROUND OF THE INVENTION (1) Field of the Invention

The instant invention relates to dispensing closures for containers and more specifically to a one-piece dispensing closure for a pouch-like container.

(2) Description of Related Art

Dispensing containers are used in a variety of industries for dispensing of various liquid products. For example, dispensing containers may be used for shampoo, lotion, condiments, or beverages. As integrated dispensing closures become more prevalent in all industries, consumers push for their use on an ever expanding array of products and packages, and product manufacturers push for unique solutions and reduced costs to promote sales and maintain profit margins.

SUMMARY OF THE INVENTION

A one-piece dispensing closure for a pouch-like container includes an integrally formed closure body, dispensing neck, hinged cap, tamper-evident tear strip and latch for maintaining the cap in an open position. The present dispensing closure is particularly configured and arranged for molding as a one-piece structure to reduce manufacturing costs.

The closure body includes a closure deck and a "canoe"-shaped skirt portion extending downwardly from the closure deck, the skirt portion being receivable within an open mouth of the pouch-like container. The skirt portion includes symmetrically opposing skirt walls with heat sealing formations on the outer surfaces thereof. These formations are configured and arranged to create a permanent, air-tight seal to the inner surfaces of the mouth of pouch container. The closure body may further include a plurality of reinforcing ribs extending transversely between the inner surfaces of the skirt walls to provide structural support while under pressure when the pouch is being heat sealed to the outer surfaces of the skirt walls.

The closure body further includes a neck portion extending upwardly from the closure deck. The skirt portion includes an entrance orifice and the neck portion includes a dispensing orifice whereby the inner surfaces thereof define a flow path through the closure body.

The dispensing closure further includes a cap having an upper wall and an outer sidewall depending downwardly from the upper wall. An integrally formed living hinge connects the cap to the closure body and provides for hinged movement of the cap between a closed position and an open position. The cap may further include an annular sealing wall depending downwardly from the upper wall which engages with the neck portion to seal the dispensing orifice when the cap is in the closed position.

An arcuate tamper-evident tear strip may be integrally formed with the neck portion where the tear strip is connected to the neck portion by at least two frangible elements extending between a lower surface of the tear strip and the outer surface of the neck portion. The tear strip is selectively detachable from the neck by a user by breaking the frangible elements.

In some embodiments, the neck is formed with a flange which forms a base for the cap and the tamper-evident tear strip.

A complementary locking tab may be formed on an outer surface of the cap. The locking tab is positioned to engage a shoulder formed on a lower edge of the tear strip when the cap is in the closed position whereby the locking tab and the shoulder cooperate to prevent the cap from being moved from the closed position to the open position without detaching the tear strip from the cap.

To selectively maintain the cap in an open position for dispensing, a latch recess may be defined within the upper wall of the cap above the living hinge and a flexible latch protrusion may be provided on the outer surface of the neck portion of the closure body below the living hinge. The latch recess frictionally engages with the latch protrusion to selectively maintain the cap in the open position.

Accordingly, embodiments of the invention may include a one-piece dispensing closure having a tamper-evident tear strip that prevents a user from opening a cap without at least partially detaching the tear strip from the cap.

In some embodiments of the instant invention, a tear strip may be provided having a shoulder that engages a locking tab on a cap body until the tear strip is at least partially detached from the cap.

In still other embodiments, reinforcing ribs extending transversely between the skirt walls may be provided to support the skirt walls while under pressure when the pouch is sealed to the outer surfaces thereof.

According to other embodiments of the invention, a latch back mechanism may be provided that allows the user to secure the cap to the closure body when the cap is in an open state, so that the cap is out of the way of the dispensing orifice on the closure body.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
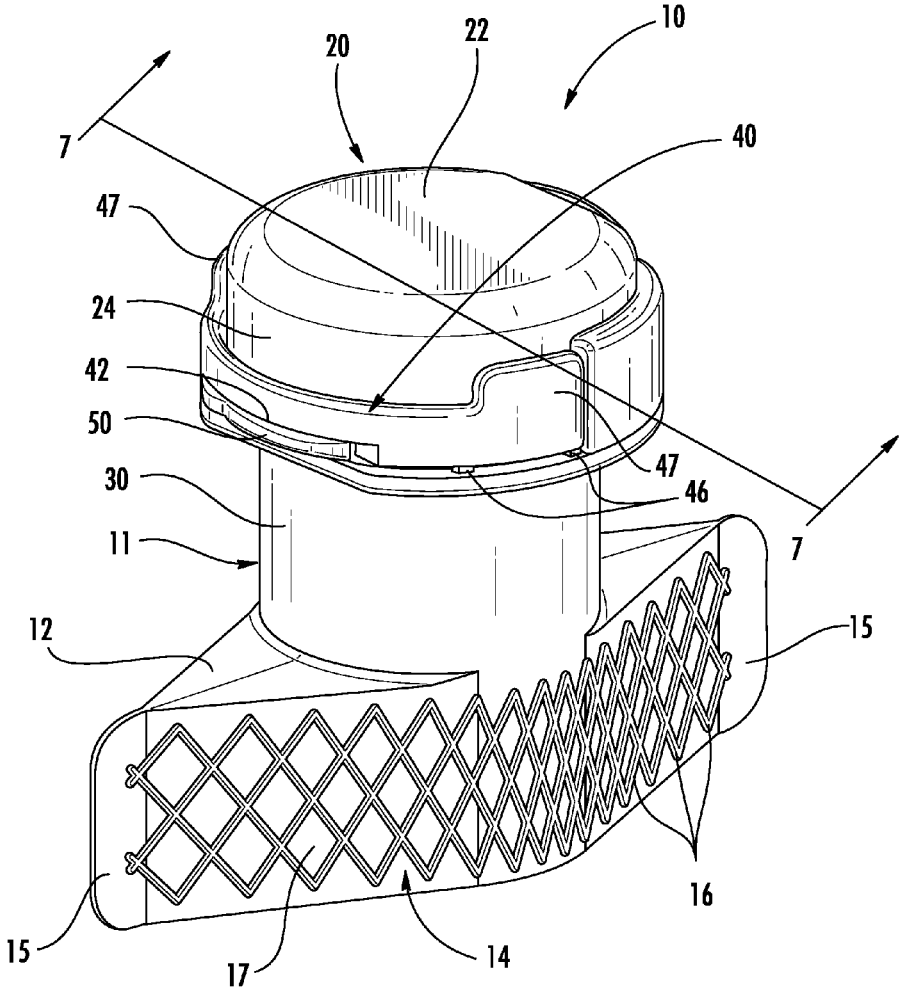
FIG. 1 is a perspective view of an embodiment of a pouch fitment of the present invention.

Referring now to the drawings, a pouch fitment according to various embodiments of the instant invention is illustrated and generally indicated at 10 in FIGS. 1-7. As will herein-after be more fully described, the instant pouch fitment 10 provides a one-piece dispensing closure for a pouch-like container 13. The fitment 10 may include an integrally formed closure body, a dispensing neck, a hinged cap, a tamper-evident tear strip and a latch for maintaining the cap in an open position. The present dispensing closure is particularly configured and arranged for molding as a one-piece entity to reduce manufacturing costs.

The pouch fitment 10 of the present invention is manufactured separately from a pouch-like container 13 and then mounted within an end of the container 13 to provide a tamper-evident closure for the pouch-like container 13. The pouch fitment 10 of FIG. 1 has a closure body 11 that includes a closure deck 12 and a "canoe"-shaped skirt portion 14 extending downwardly from the closure deck 12. The skirt portion 14 is formed by symmetrically opposing skirt walls 17, 19 which are receivable within an open mouth of the pouch-like container. The skirt walls 17, 19 are joined together at their terminal vertical edges 15. Sealing formations 16 provided on the outer surfaces 18 of the skirt walls 17, 19 are configured and arranged for sealing the outer surface of the skirt walls 17, 19 to the inner surfaces of the mouth of the pouch container 13. For example, using known heat sealing processes, a pouch fitment is placed within an open end of a pouch-like container 13 and an outer surface of the skirt portion 14 is in facing engagement with an inner surface of the pouch-like container 13, the sealing formations 16 are heated, forming a seal between the container and the pouch fitment. This seal between the skirt portion and the container is sufficiently strong that the seal does not deteriorate during shipment and normal use of the product. While the Figures illustrate particular patterns in the sealing formations 16, it is understood that other patterns may also be incorporated with various embodiments of the invention.

In order to reinforce the structural integrity of the skirt walls 17, 19 while under the pressure of a sealing process, the closure body includes a plurality of reinforcing ribs 21 extending transversely between the inner surfaces of the skirt walls 17,19. In some embodiments of the invention, the reinforcing ribs 21 are provided in symmetrically opposing pairs, and more preferably the ribs 21 are comprised of pairs of ribs which cross each other to form an X-shaped truss reinforcement. In this regard, the ribs are aligned to absorb the brunt of the compressive force of the sealing pressure in a linear fashion.

Although FIGS. 1-7 show a canoe-shaped skirt portion 14, other shapes could be used to engage containers having different outer shapes. For example, a circular skirt portion 14 could be used to engage a container end that is in the shape of a circular tube. Other shapes could be used without departing from the scope of the present invention.

Figure 2:
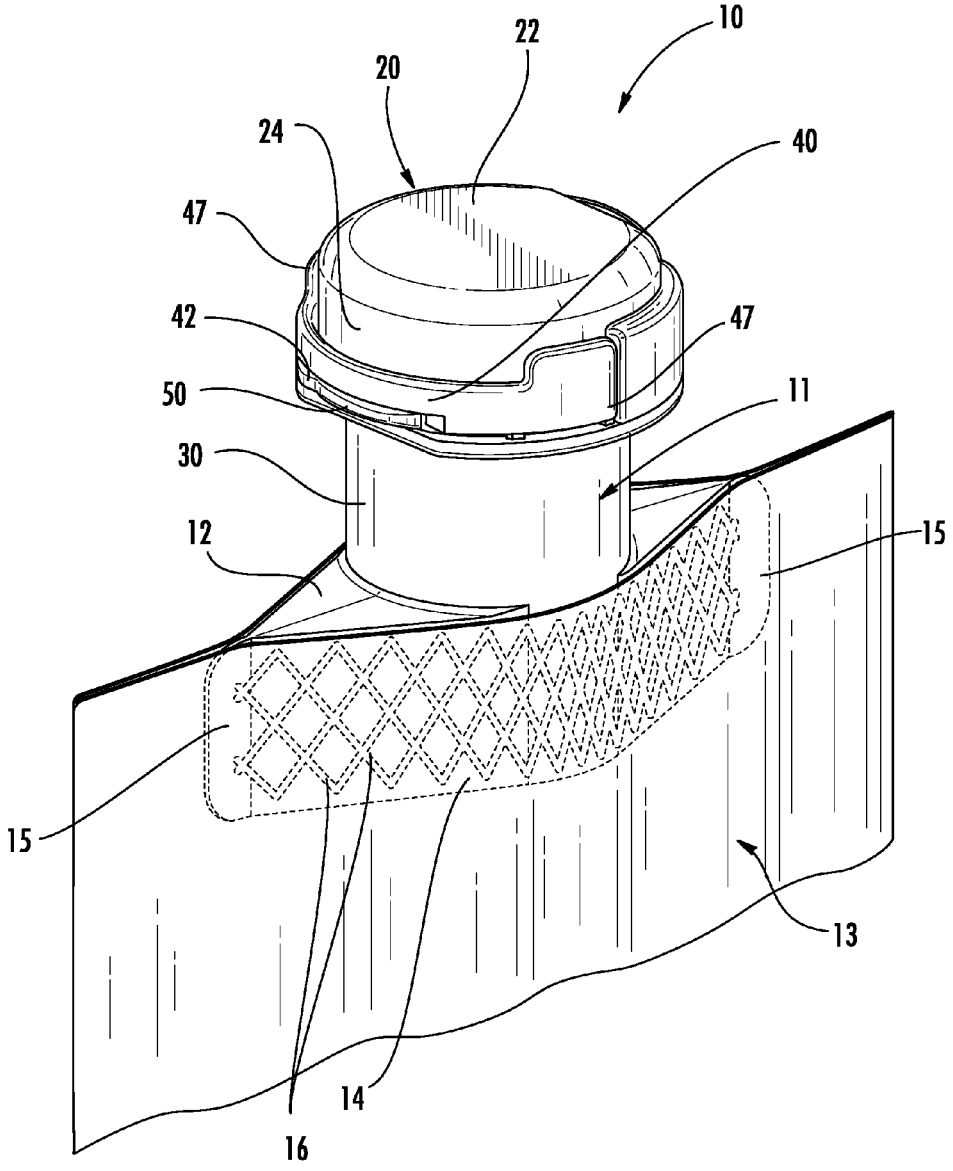
FIG. 2 is another perspective view thereof showing a film pouch container sealed to the skirt walls.
Figure 3:
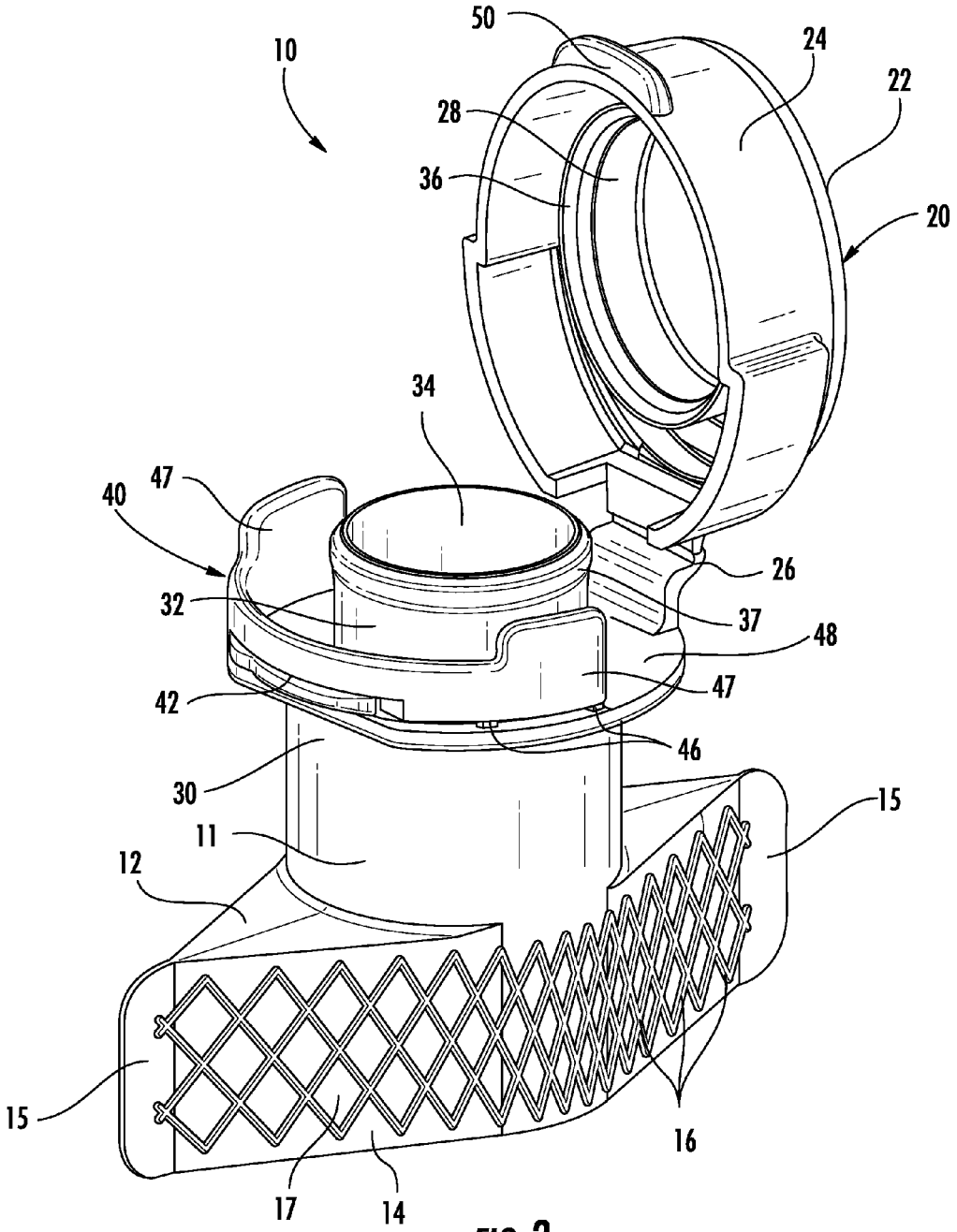
FIG. 3 is yet another perspective view thereof with the cap in an open position.

The skirt portion 14 of the pouch fitment of various embodiments of the present invention is integrally formed with the cap 20, neck portion 30, and tear strip 40, among other features. The pouch fitment may be formed by injection molding, though other manufacturing methods may be used without departing from the scope of the present invention. FIG. 1 shows the pouch fitment as it may appear after being manufactured but before it has been secured in the mouth of a pouch or first closed by the manufacturer. FIG. 2 shows the fitment 10 sealed to the container 13, such as by heat sealing.

When the pouch fitment is secured to a pouch that is filled with a product such as shampoo, food, or other liquid, the manufacturer may close the cap so the product may be shipped to the consumer. The cap 20 is formed with an upper wall 22 and an outer sidewall 24 depending downwardly from the upper wall 22. After purchase, the end user may move the cap 20 to an open position, such as in FIG. 3, from a closed position, such as in FIG. 1, and back by way of an integrally formed living hinge 26 that connects the cap 20 to the closure body 11.

Figure 7:
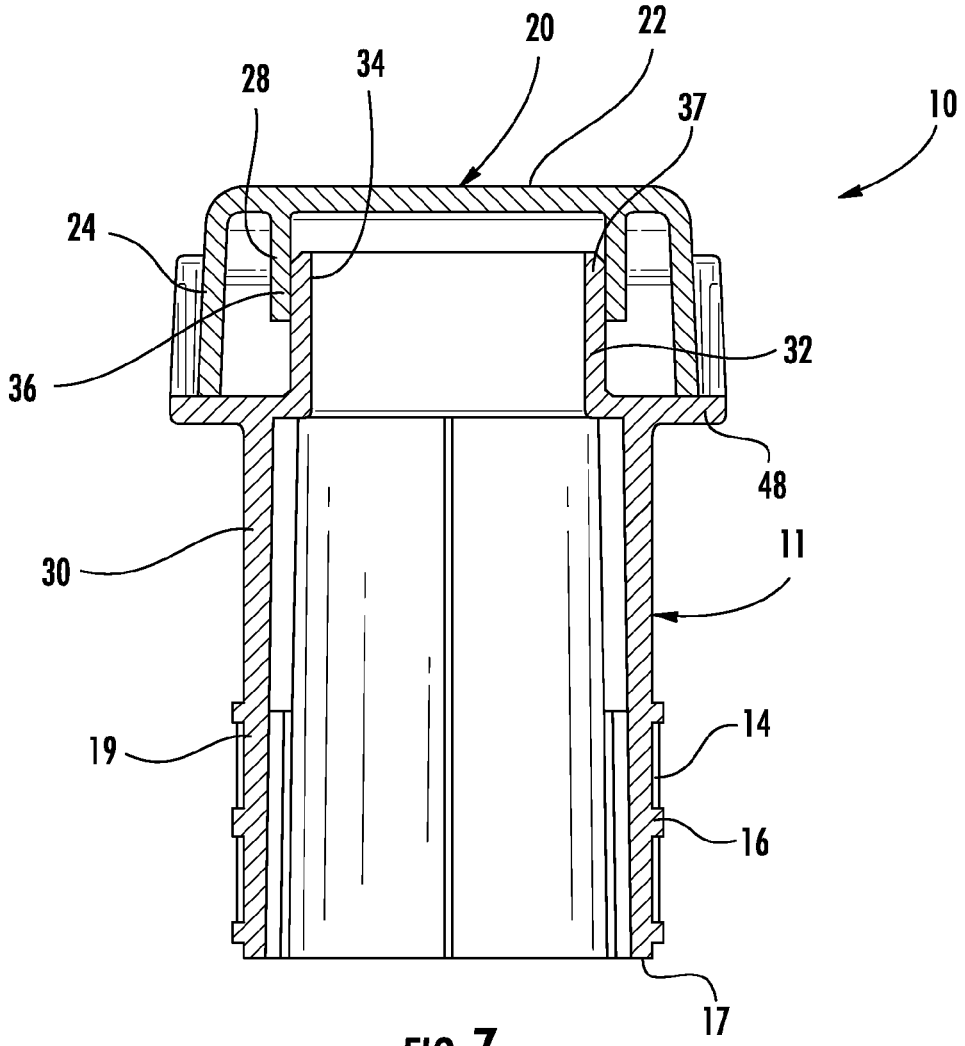
FIG. 7 is a cross-sectional view thereof taken along line 7-7 of FIG. 1.

In the closed position of FIG. 1, the upper end 32 of the neck portion 30 partially extends within the area enclosed by the outer sidewall 24 of the cap 20. An annular sealing wall 28 depending downwardly from the upper wall 22 of the cap 20 engages with the dispensing neck to seal the dispensing orifice 34 as illustrated in FIG. 7. More specifically, a sealing lip 36 extends inwardly from the peripheral edge of the sealing wall 28 to flexibly engage a complementary sealing bead 37 on the outer surface of the dispensing neck, thus forming a seal around the circumference of the dispensing neck so that contents of the pouch cannot pass through dispensing orifice 34 of the pouch fitment, which is described in more detail below. In some embodiments of the invention, the sealing lip 36 and sealing bead 37 may be configured such that engagement of the sealing lip 36 and sealing bead 37 produces and audible sound—such as a "click"—which may inform a user that sealing engagement has been accomplished.

As illustrated in the Figures and according to various embodiments of the invention, a cap 20 may open parallel to a linear axis extending lengthwise through the skirt portion 14. In still other embodiments, that portion of the pouch fitment 10 above the skirt portion 14 may be rotated in any desired position such that the cap 20 may be opened in a particular direction. For example, rotating that portion of the pouch fitment 10 by ninety degrees would allow the cap 20 to be opened perpendicular to the length of the skirt portion 14, which may be desirable with certain embodiments of the invention.

When the container is first provided to a consumer, it is important for the consumer to be able to identify whether the container has been previously opened. For this purpose, embodiments of the present invention provide an arcuate tamper-evident tear strip 40 that may be integrally formed with the cap 20.

Before the tamper-evident tear strip 40 is removed by the user, the tear strip 40 prevents the cap from being moved from the closed position to an open position. As shown in FIG. 1, the tear strip 40 includes a shoulder 42 formed on lower edge thereof. A locking tab 50 is formed on the outer surface of the cap 20. When the manufacturer first moves the cap from an open to a closed position, the locking tab 50 engages the shoulder 42 on the tear strip 40 and prevents the cap 20 from being moved from the closed position to the open position without detaching the tear strip 40 from the cap 20.

Alternate embodiments of the present invention may include a multiple locking tabs that engage different shoulders without departing from the scope of the present invention.

Before dispensing the contents of the container, the consumer must at least partially detach the tamper-evident tear strip 40 from the cap 20 so that the locking tab 50 of the cap 20 no longer engages the shoulder 42 of the tear strip 40. The drawings show that the tear strip 40 is connected to the neck by at least two frangible elements 46 extending between a lower surface of the tear strip and an outer surface of the neck 30. Pull tabs 47 are provided at opposing ends of the tear strip 40 to enable the consumer to more easily grip the tear strip 40 and pull it away from the neck 20. Thus, before opening the container, the consumer may inspect the tear strip 40 to see that the frangible elements 46 remain connected to both the tear strip 40 and the neck, and then the consumer may remove the tear strip 40 from the cap 20 by breaking the frangible elements 46.

Other embodiments may use more or fewer frangible elements 46 without departing from the scope of the present invention.

In some embodiments, the neck 30 may be formed with a flange 48 which forms a base for the cap 20 and the tamper-evident tear strip 40. In this regard, the living hinge 26 and the frangible elements 46 may extend from the flange 48.

After the consumer removes the tear strip 40 and moves the cap 20 to an open position, the contents of the pouch may be dispensed. With the skirt portion 14 sealed to the dispensing end of the container, any products dispensed from that end of the container must pass through a flow path defined within the pouch fitment (See FIG. 7). In FIG. 7, the flow path can be seen to extend through the interior of the closure 10 from the lower edge of the skirt walls 17 upwardly through the top edge of the dispensing orifice 34.

Figure 6:
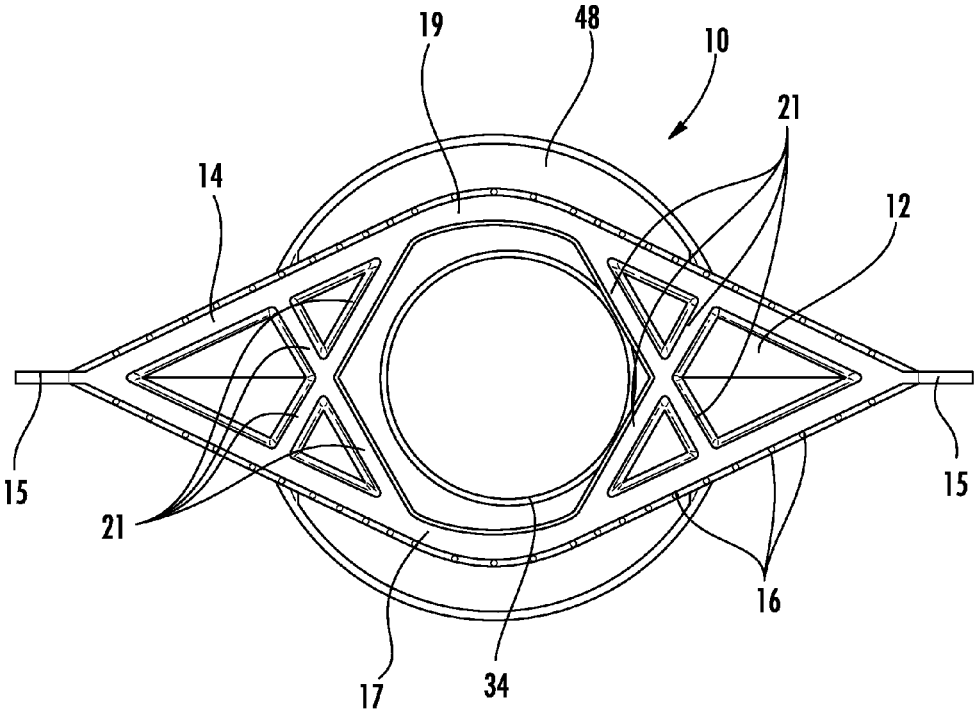
FIG. 6 is a bottom view thereof.

The dispensing orifice 34 is shown in FIG. 1 as being generally circular (See also FIG. 6). However, in other embodiments, different shapes may be used to suit manufacturer or user preferences. For example, an elongated oval or rectangular dispensing orifice 34 could be used where it is beneficial to dispense a thin, flat layer of a product. It is also noted that the dispensing orifice 34 is positioned slightly offset from center in the illustrated embodiment to accommodate the position of the living hinge 26 and height of the dispensing neck. The positioning and/or centering of the orifice 34 may be adjusted to accommodate various design needs. Other dispensing orifice designs can be used without departing from the scope of the present invention.

Figure 4:
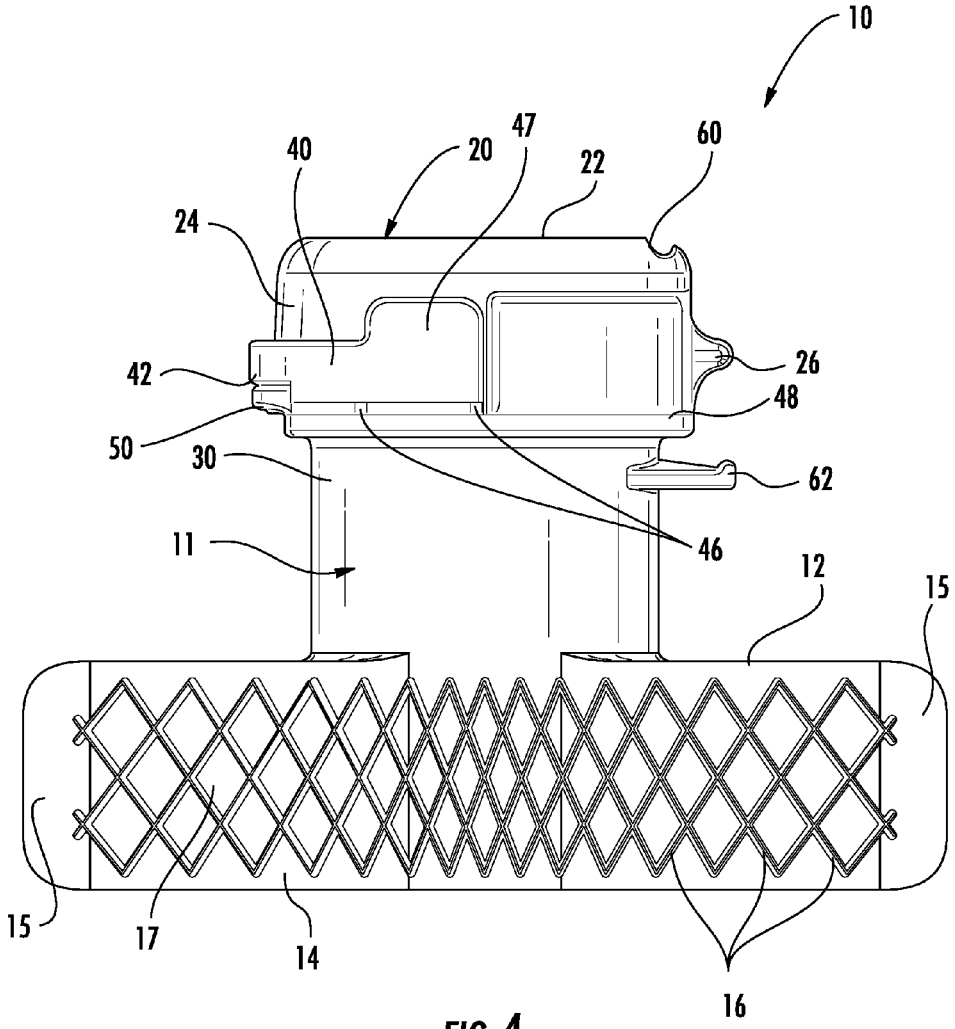
FIG. 4 is a side view thereof.
Figure 5:
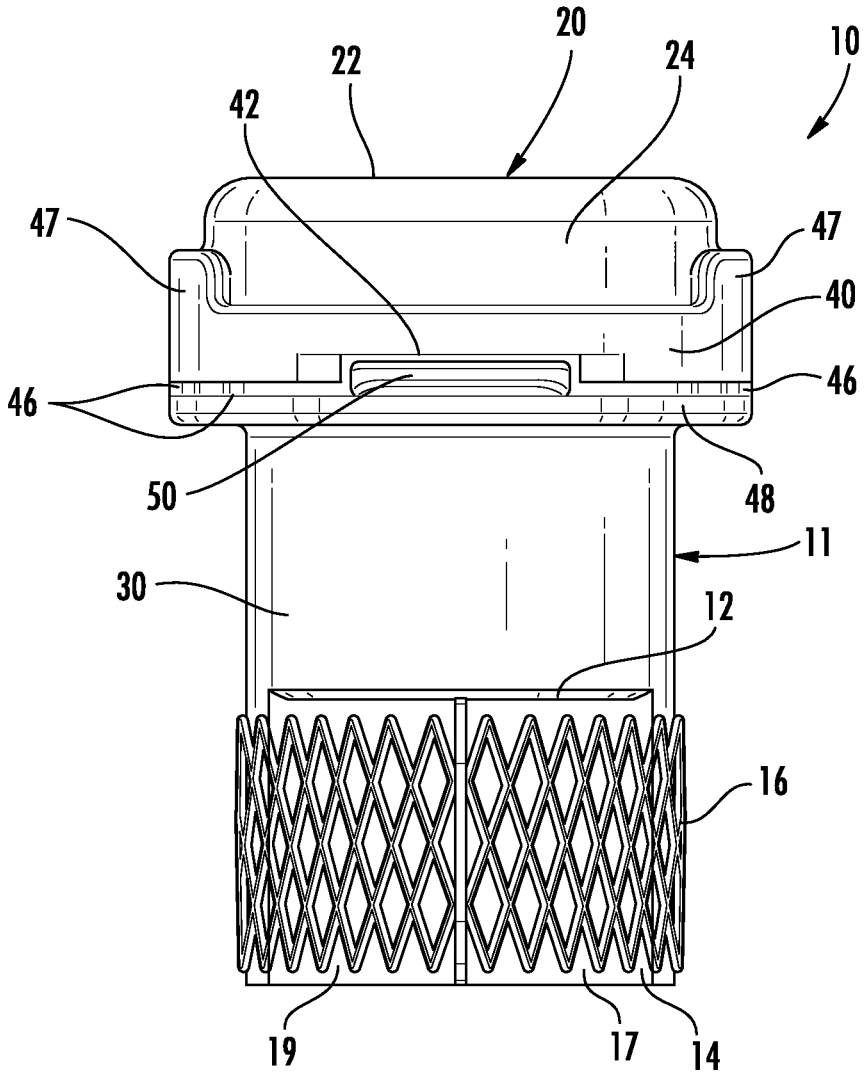
FIG. 5 is an end view thereof.

To selectively maintain the cap in an open position for dispensing, and to keep it out of the way of the product being dispensed, a latch recess 60 may be defined within the upper wall of the cap 20 above the living hinge and a flexible latch protrusion 62 may be provided on the outer surface of the neck portion 30 of the closure body below the living hinge 26. The latch recess 60 frictionally engages with the latch protrusion 62 to selectively maintain the cap 20 in the open position. In FIG. 4, the latch protrusion 62 is shown as having a convex arcuate profile. FIG. 4 also shows the latch recess 60 as having a concave arcuate profile that generally corresponds to the arcuate profile of the convex latch protrusion 62 such that the protrusion may be more fully received in the latch recess 60. This improves the frictional engagement of the latch protrusion and latch recess.

Figure 8:
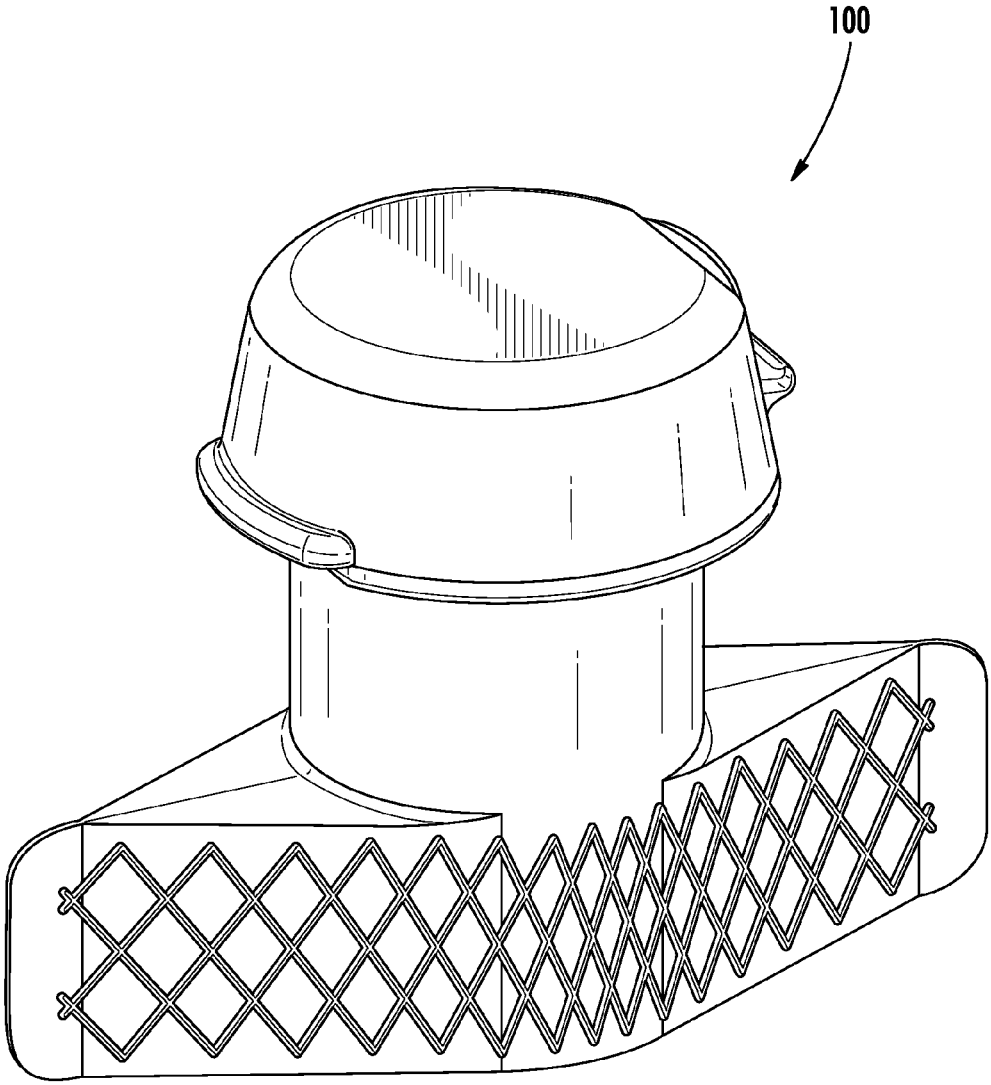
FIG. 8 is a perspective view of an alternate embodiment.
Figure 9:
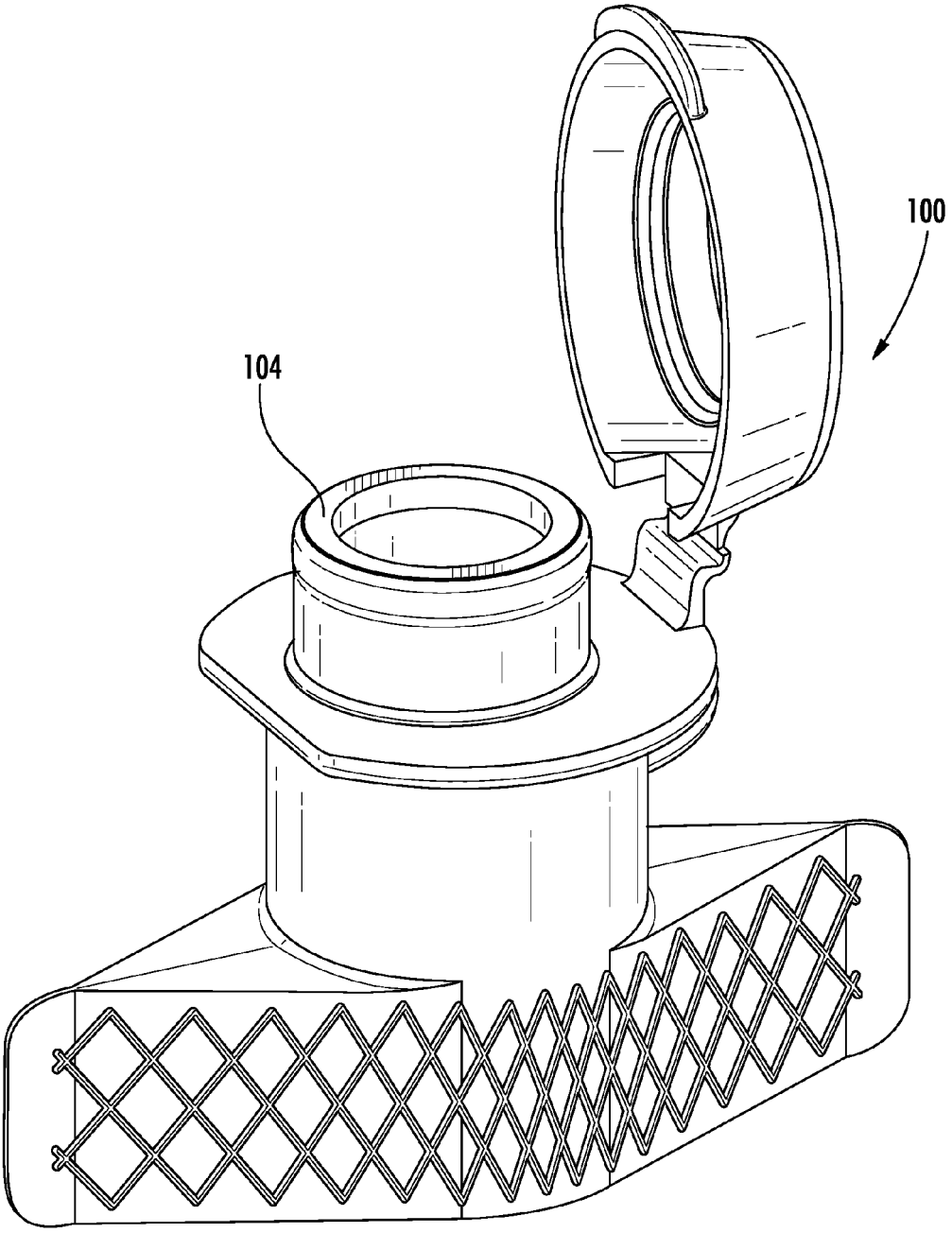
FIG. 9 is another perspective view showing the cap thereof in an open position.
Figure 10:
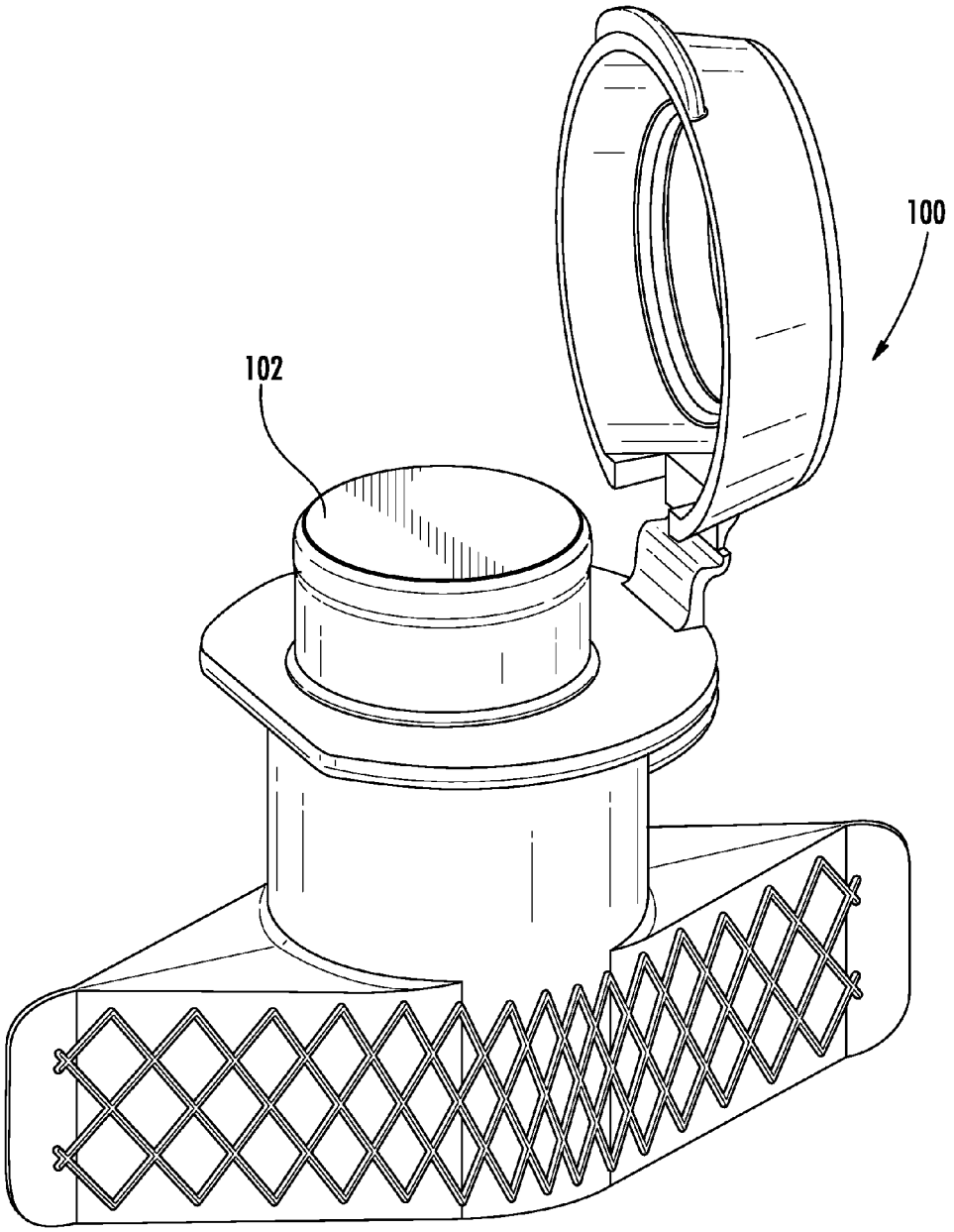
FIG. 10 is still another perspective view showing a film seal over the opening of the dispensing orifice.

Turning to FIGS. 8-10, an alternate embodiment of the closure is illustrated and generally indicated at 100. The closure 100 has all of the same features and attributes as the first embodiment with the exception of the tamper evident tear strip. According to some embodiments of the invention, a closure may include a foil liner (see FIG. 10) or other barrier liner which is sealed to a flat edge (see FIG. 9) on the upper end of the dispensing orifice. Such a liner may be used with or in place of other tamper evident features with various embodiments of the invention.

It can therefore be seen that certain embodiments of the instant invention provide a one-piece dispensing closure having a tamper-evident tear strip that helps to prevent a user from opening a cap without at least partially detaching the tear strip from the cap.

Various embodiments of the invention also provide a tear strip having a ledge that engages a locking tab on a cap body until the tear strip is at least partially detached from the cap.

In other embodiments, a latch back mechanism that allows the user to secure the cap to the closure body when the cap is in an open state, so that the cap is out of the way of the dispensing orifice on the closure body may also be incorporated with a closure.

Figure 11:
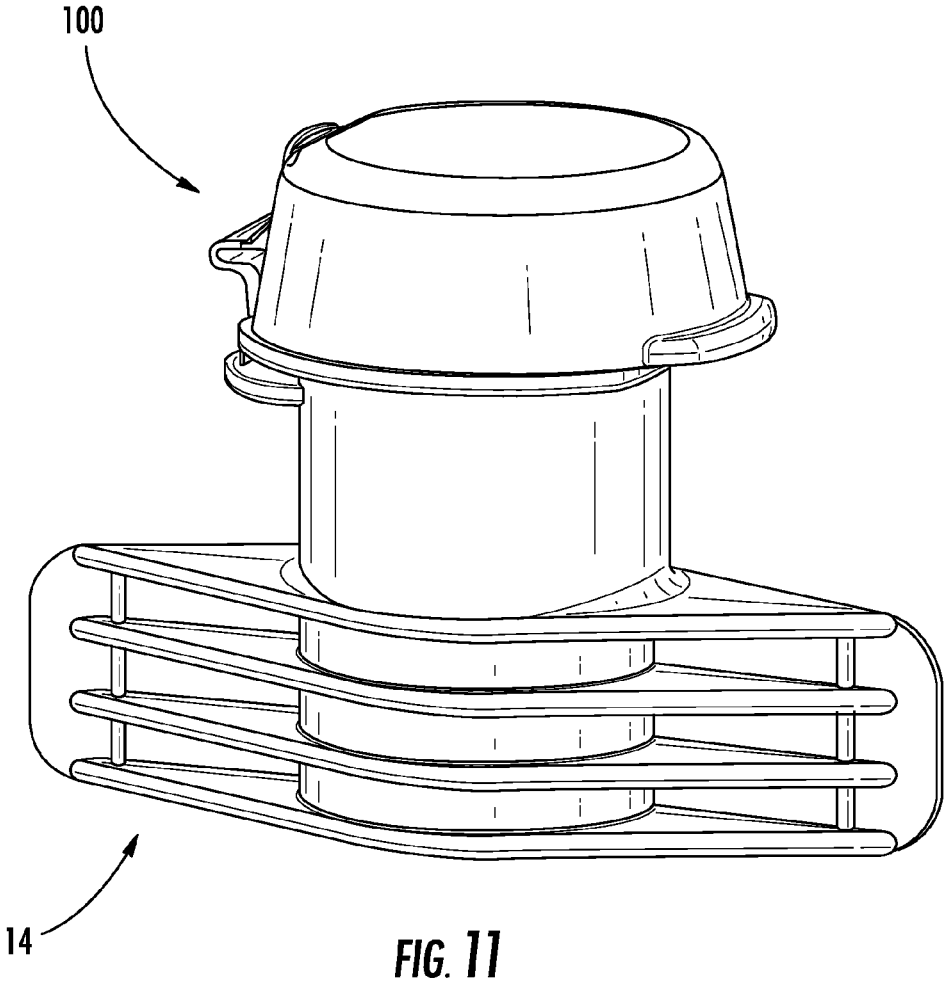
FIG. 11 is a perspective view of an alternate embodiment.
Figure 12:
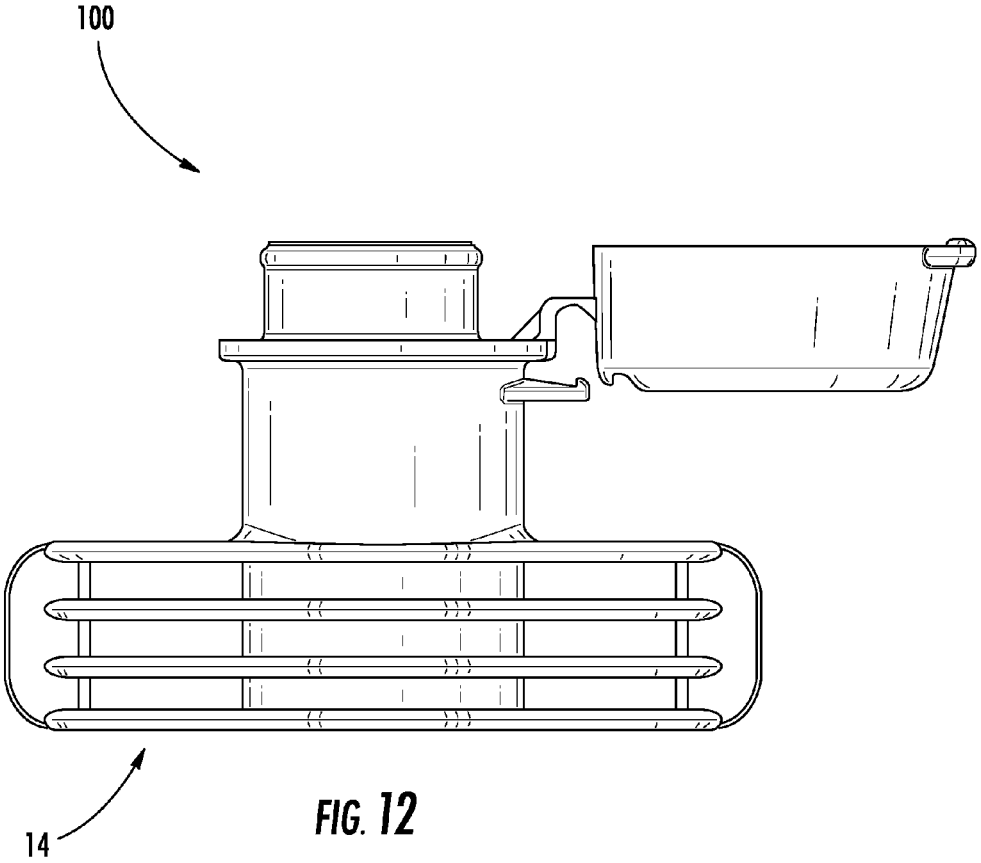
FIG. 12 is a side view of an embodiment in an open position.
Figure 13:
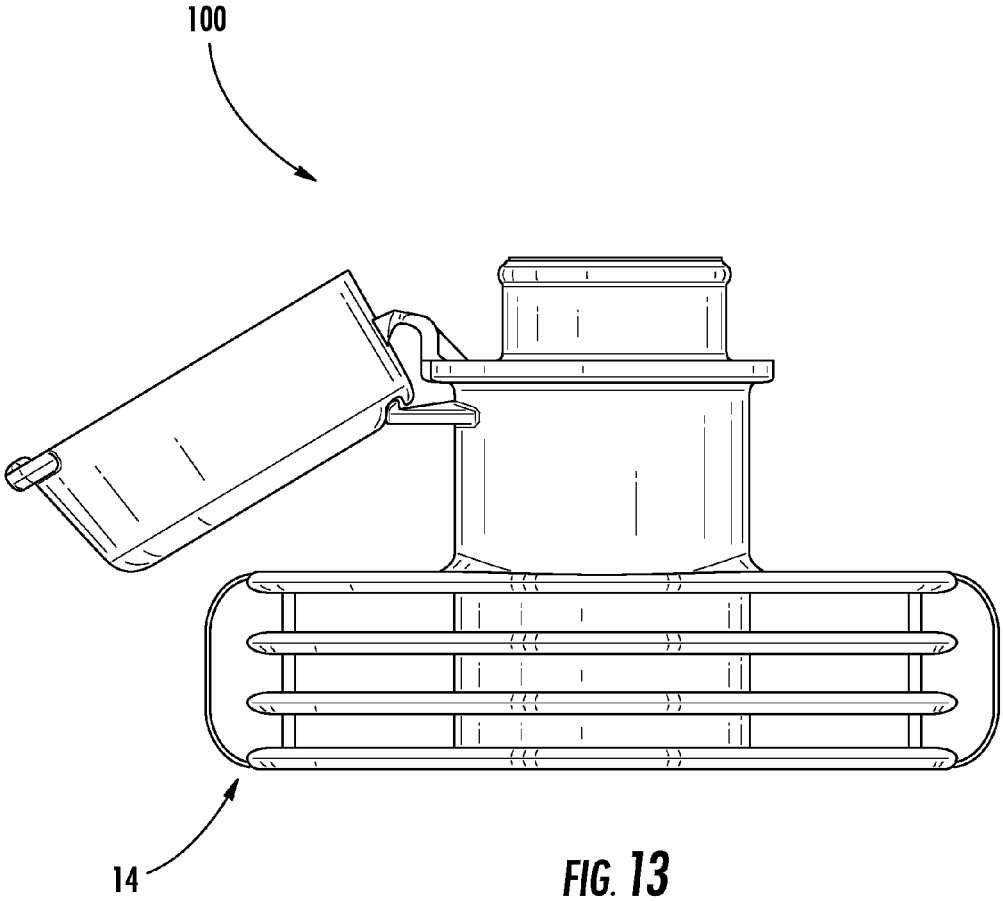
FIG. 13 is a side view of an embodiment in a latch-back position.
Figure 14:
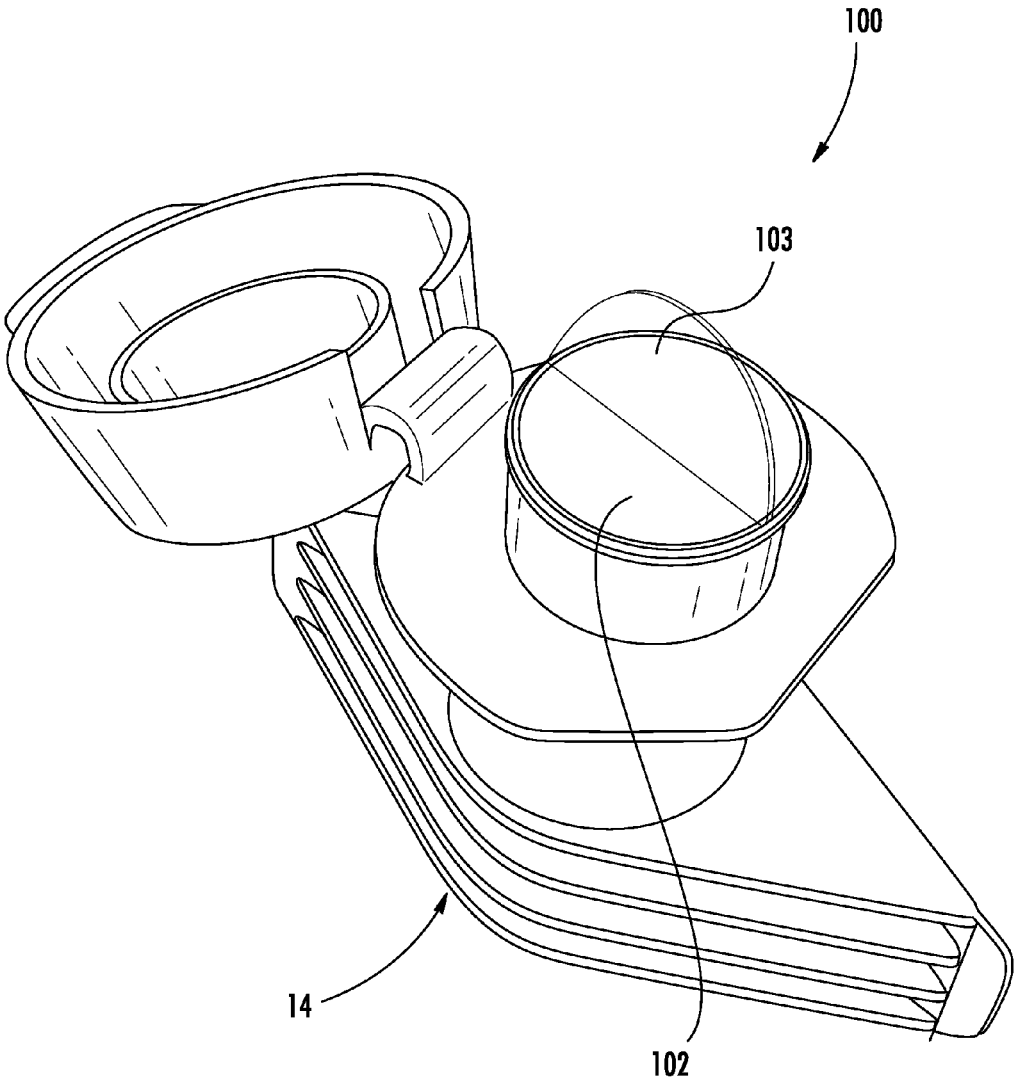
FIG. 14 is a perspective view of an alternate embodiment.

FIGS. 11 through 13 show an alternate embodiment of a closure according to various embodiments of the invention. A closure 100 may include all of the same features and attributes as other embodiments described herein, with the exception of the tamper evident tear strip and a differently configured or shaped canoe-shaped skirt portion 14. According to some embodiments of the invention, a closure 100 may include a plastic or foil liner 102 as illustrated in FIG. 14. The plastic or foil liner 102 may include one or more flaps 103 which may facilitate removal of the plastic or foil liner 102 from the closure 100.

The canoe-shaped skirt portion 14 illustrated in FIGS. 11 through 14 may include, or may omit, the use of reinforcing ribs 21 used with other embodiments of the invention. In addition, other embodiments of the invention may incorporate known canoe designs or canoe-shaped skirt portions 14 with other elements of the embodiments of the invention.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A one-piece dispensing closure for use with a pouch-like container, said dispensing closure comprising:

a closure body having a closure deck and an canoe-shaped skirt portion extending downwardly from said closure deck, said skirt portion having symmetrically opposed skirt walls which are receivable within an open mouth of said pouch-like container, said skirt walls having sealing formations on outer surfaces thereof which are configured and arranged for sealing to an inner surface of said mouth of said container, said closure body further including reinforcing ribs extending transversely between inner surfaces of said skirt walls, said closure body further including a neck portion extending upwardly from said closure deck, said skirt portion including an entrance orifice and said neck portion including a dispensing orifice whereby inner surfaces thereof define a flow path through said closure body;

a cap having an upper wall and an outer sidewall depending downwardly from said upper wall;

an integrally formed living hinge connecting said cap to said closure body and providing for hinged movement of said cap between a closed position and an open position, said cap further including an annular sealing wall depending downwardly from said upper wall and engaging with said neck portion to seal said dispensing orifice when said cap is in said closed position;

an arcuate tamper-evident tear strip integrally formed with said cap, said tear strip being connected to said neck portion by at least two frangible elements extending between a lower surface of the tear strip and the outer surface of the neck portion, said tear strip being selectively detachable from said neck by a user by breaking said frangible elements;

a locking tab formed on an outer surface of said cap, said locking tab being positioned to engage a shoulder formed on a lower edge on said tear strip when said cap is in said closed position, said locking tab and said shoulder cooperating to prevent said cap from being moved from said closed position to said open position without detaching said tear strip from said cap;

a latch recess defined within said upper wall of said cap above said living hinge; and a flexible latch protrusion on an outer surface of said neck portion of said closure body below said living hinge, said latch recess engaging with said latch protrusion to selectively maintain said cap in said open position.

2. The dispensing closure of claim 1 wherein said tear strip includes pull tabs at opposing ends thereof to facilitate removal of the tear strip.

3. The dispensing closure of claim 1 wherein said frangible elements are located adjacent opposing ends of the tear strip.

4. The dispensing closure of claim 1 further comprising a sealing bead on an outer peripheral lip of said dispensing orifice and a complementary sealing lip on an inner surface of said annular sealing wall, said sealing lip frictionally interlocking with said sealing bead when said cap is in said closed position.

5. The dispensing closure of claim 1 wherein said reinforcing ribs comprise symmetrically opposed pairs of ribs.

6. The dispensing closure of claim 5 wherein said symmetrically opposed pairs of ribs cross each other to form the shape of an X.

7. A dispensing closure, comprising:

a closure deck;

symmetrically opposed skirt walls extending downwardly from the closure deck;

reinforcing ribs extending transversely between inner surfaces of the skirt walls;

a neck portion extending upwardly from the closure deck;

an entrance orifice and a dispensing orifice bounding a flow path through the dispensing closure;

a cap, comprising:

an upper wall;

an outer sidewall depending downwardly from the upper wall;

an annular sealing wall depending downwardly from the upper wall;

a living hinge connecting the cap to the neck portion;

wherein the dispensing closure is a unitary molded structure.

8. The dispensing closure of claim 7, wherein the annular sealing wall is configured to engage with and seal the dispensing orifice.

9. The dispensing closure of claim 7, wherein the annular sealing wall is configured to engage with the neck portion.

10. The dispensing closure of claim 7, further comprising an arcuate tamper-evident tear strip connected to the neck portion by at least one frangible element.

11. The dispensing closure of claim 7, further comprising a barrier liner disposed over the dispensing orifice.

12. The dispensing closure of claim 11, wherein the barrier liner comprises a foil liner.

13. The dispensing closure of claim 7, wherein the annular sealing wall further comprises a sealing lip and the neck portion further comprises a sealing bead configured to engage with the sealing lip, wherein such engagement produces an audible noise.

* * * * *